US008011935B2

(12) United States Patent
Ko

(10) Patent No.: US 8,011,935 B2
(45) Date of Patent: Sep. 6, 2011

(54) CABLE CONNECTOR ASSEMBLY WITH AN IMPROVED RING MEMBER

(75) Inventor: David Ko, Fullerton, CA (US)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 12/779,969

(22) Filed: May 14, 2010

(65) Prior Publication Data

US 2010/0291791 A1 Nov. 18, 2010

(30) Foreign Application Priority Data

May 14, 2009 (CN) ..... 2009 2 0303148

(51) Int. Cl.
*H01R 12/00* (2006.01)

(52) U.S. Cl. ..... 439/76.1; 439/490

(58) Field of Classification Search ..... 439/63, 439/76.1, 490, 581, 582, 620.01, 620.21, 439/620.22

See application file for complete search history.

(56) References Cited

U.S. PATENT DOCUMENTS

| | | | | |
|---|---|---|---|---|
| 7,607,937 | B1 * | 10/2009 | Chang | 439/490 |
| 7,677,916 | B2 * | 3/2010 | Chang | 439/490 |
| 7,722,363 | B2 * | 5/2010 | Zhou et al. | 439/76.1 |
| 7,753,689 | B1 * | 7/2010 | Wu | 439/63 |
| 7,789,675 | B2 * | 9/2010 | Zhang et al. | 439/76.1 |
| 7,857,666 | B2 * | 12/2010 | Chen et al. | 439/675 |

* cited by examiner

*Primary Examiner* — Thanh-Tam T Le
(74) *Attorney, Agent, or Firm* — Wei Te Chung; Andrew C. Cheng; Ming Chieh Chang

(57) ABSTRACT

A cable connector assembly (100) comprises a mating member (3), a printed circuit board (2), a LED (24) attached to the printed circuit board, a cable (6), a light pipe (4) having a visible area (431), an insulative shell (1), and a ring member (5). The cable has a positive wire (61) and a negative wire (62) connected with the mating member (3), and a strain relief portion (64) molded on the wires and neighboring to said light pipe. A detective contact (631) is connecting with the cable. The insulative shell encloses the printed circuit board, the cable and the mating member. The visible area (431) is exposed out of the insulative shell. The ring member has a slick loop portion (51) located in said light pipe and a retaining portion (52) with a rugged exterior surface, and said strain relief portion is molded on the retaining portion.

16 Claims, 6 Drawing Sheets

CABLE CONNECTOR ASSEMBLY WITH AN IMPROVED RING MEMBER

BACKGROUND OF THE INVENTION

1. Field of the Invention

The present invention generally relates to a cable connector assembly, and more particularly to a cable connector assembly transmitting power signal.

2. Description of Related Art

Nowadays, cable connector assemblies are widely used in an electronic equipment, especially for transmitting power, and the performance of the cable connector assembly directly impacts on the entire electronic equipment whether can normally run.

A conventional cable connector assembly comprises a printed circuit board, a Light Emitting Diode (LED) attached to the printed circuit board to indicate the working status of the cable connector assembly, a light pipe receiving the LED, a cable with a plurality of wires, a plurality of contacts connected with the cable, a columnar mating member, and an insulated shell enclosing the printed circuit board, the LED, the light pipe and the mating member partially. The wires include a positive wire and a negative wire, both of them comprise an inner conductor and an insulative outer jacket respectively. The outer jackets of the positive wire and the negative wire have different colors to be distinguished. The cable also defines a fuscous strain relief portion on a front part thereof, but the strain relief portion may prevent the light from the LED passing therethrough, so as to it may be difficult for users to observe actual working status of the cable connector assembly as the light weaken. Therefore, a ring member is designed between the light pipe and the strain relief portion in field to avoid aforementioned disadvantage effectively. However, the strain relief member may be unstable with the ring member received in the light pipe wholly.

Hence, it is desirable to have an improved structure to overcome the above-mentioned disadvantages of the prior art.

BRIEF SUMMARY OF THE INVENTION

Accordingly, the object of the present invention is to provide a cable connector assembly with an improved ring member to enhance the combination with a strain relief portion.

In order to achieve the above-mentioned object, a cable connector assembly in accordance with the present invention comprises a mating member, a printed circuit board, a LED attached to the printed circuit board, a cable, a light pipe having a visible area, an insulative shell, and a ring member. The cable has a positive wire and a negative wire connected with the mating member, and a strain relief portion molded on the wires and neighboring to said light pipe. A detective contact is connecting with the cable. The insulative shell encloses the printed circuit board, the cable and the mating member. The visible area is exposed out of the insulative shell. The ring member has a slick loop portion located in said light pipe and a retaining portion with a rugged exterior surface, and said strain relief portion is molded on the retaining portion.

Other objects, advantages and novel features of the invention will become more apparent from the following detailed description of the present embodiment when taken in conjunction with the accompanying drawings.

DETAILED DESCRIPTION OF THE INVENTION

Figure 1:
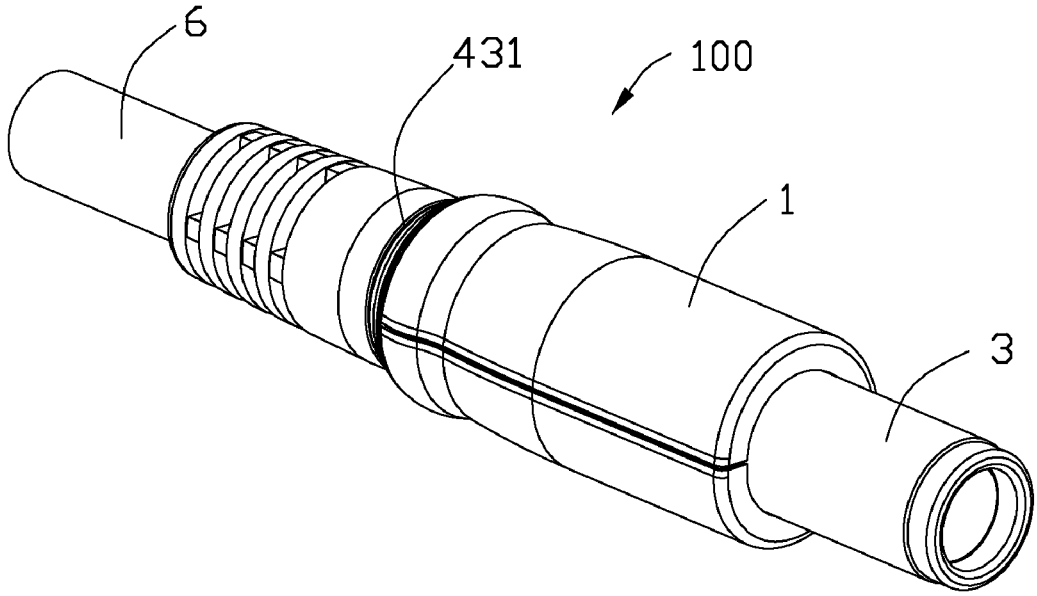
FIG. 1 is an assembled view of a cable connector assembly in accordance with the present invention.

Reference will now be made to the drawing figures to describe the present invention in detail.

Figure 2:
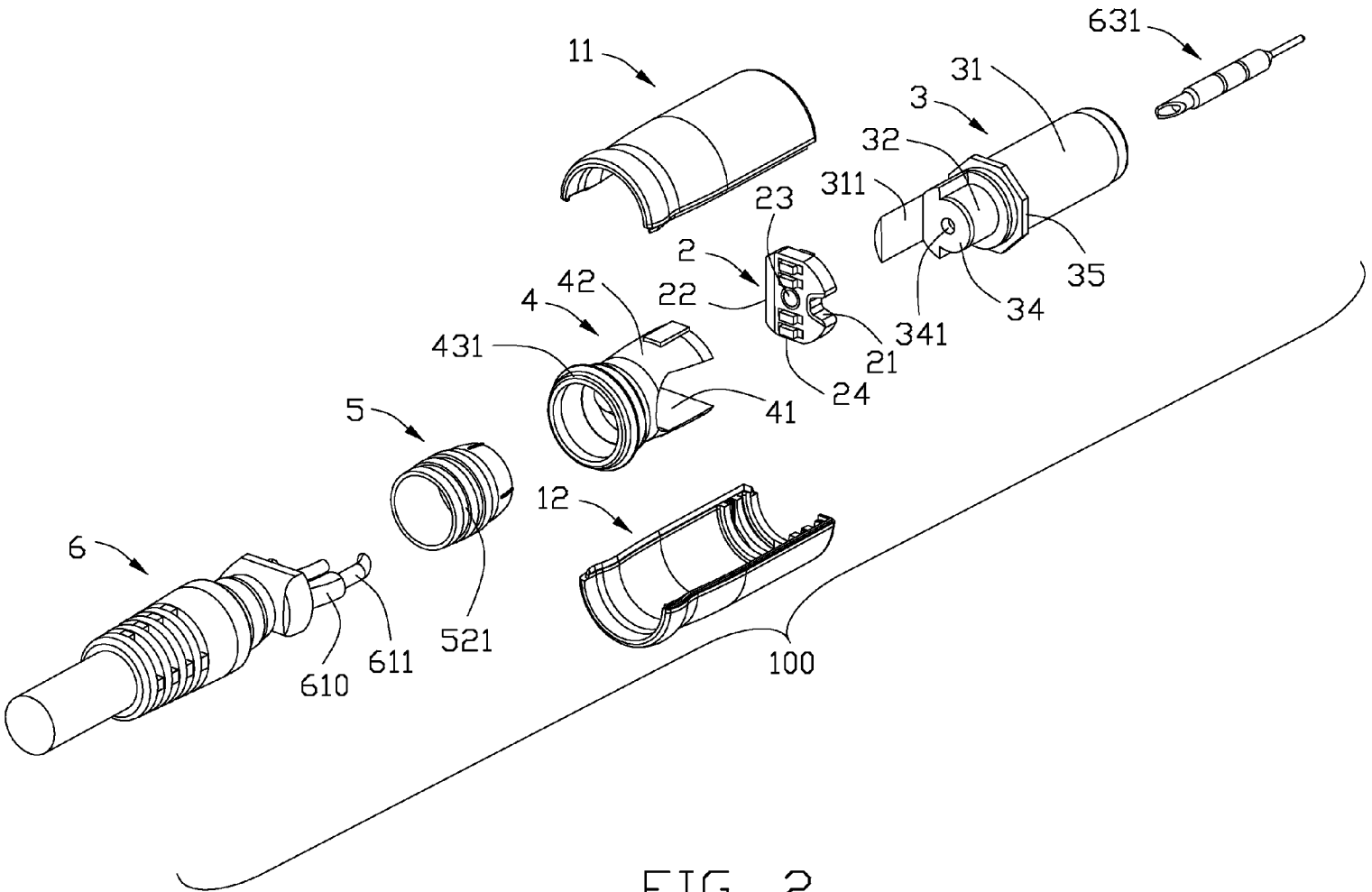
FIG. 2 is an exploded view of the cable connector assembly shown in FIG. 1.

Referring to FIGS. 1-2, a cable connector assembly 100 made in accordance with the present invention comprises a printed circuit board 2 perpendicular to a mating direction, a cylindrical mating member 3, a light pipe 4, a ring member 5, a cable 6 with a plurality of wires, and an insulative shell 1 enclosing the aforementioned components. A detective pin 631 is connected with one of the wires.

Figure 3:
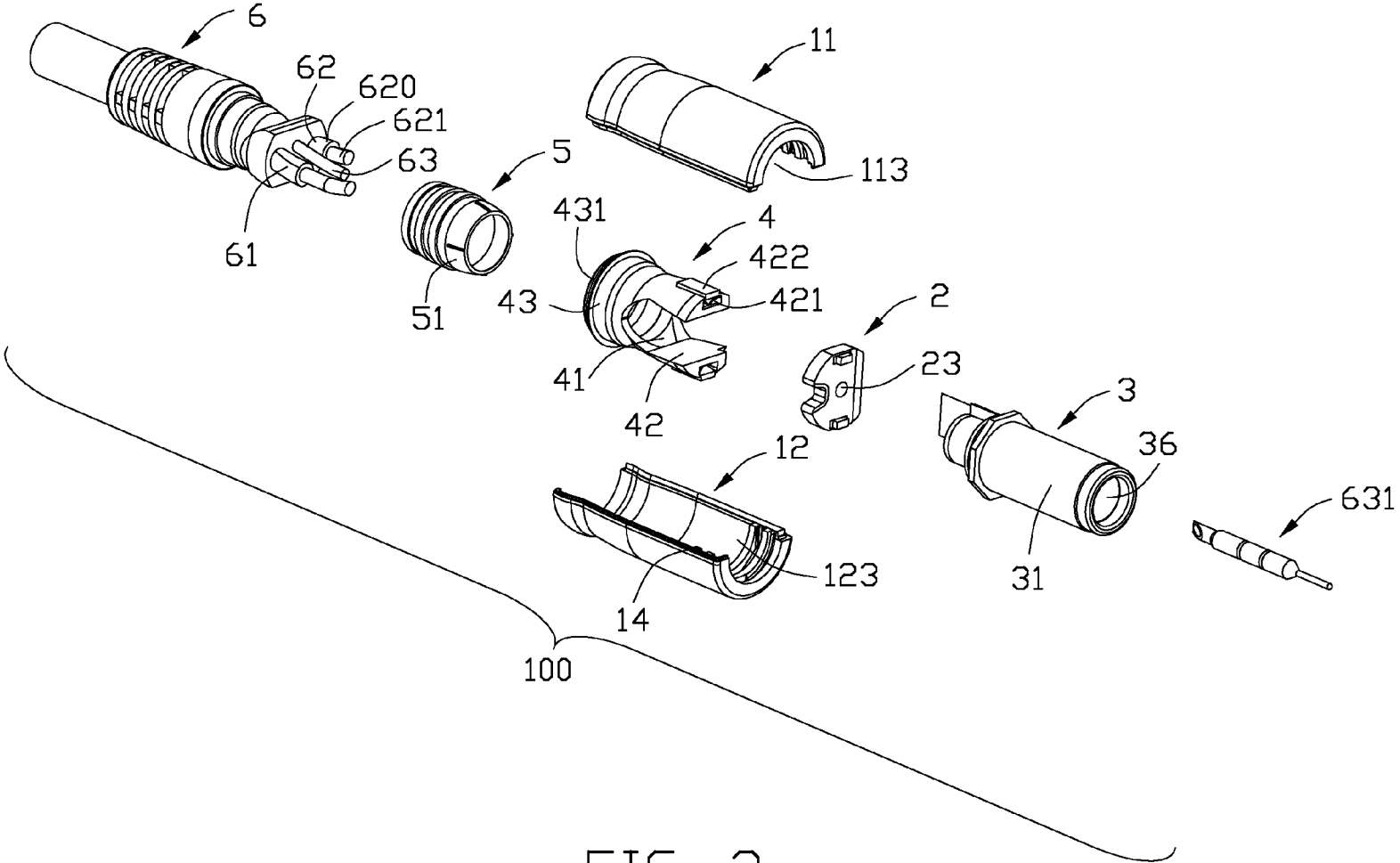
FIG. 3 is a view similar to FIG. 2, but viewed from a different angle.

Referring to FIGS. 2-3, the insulative shell 1 has a hollowed configuration with a cylindrical shape, and is configured with a bottom shell 11 and a top shell 12. The bottom shell 11 defines a first semicircular hole 113 recessed downwardly, the bottom shell 12 is symmetrical to the top shell 11 in shape, the top shell 12 has a second semicircular hole 123 together with the first semicircular hole 113 to form a circular hole. Both of the top shell 11 and the bottom shell 12 define a rectangle groove 14 respectively.

The printed circuit board 2 is arranged along a direction vertical to the mating direction, the mating member 3 and the cable 6 are located on opposite sides of the printed circuit board 2. The printed circuit board 2 comprises a first conductive area 21 and a second conductive area 22 disposed on opposite edges thereof, the first conductive area 21 is arranged in an aperture (not numbered), and the second conductive area 22 is disposed on an upright side. The first and second conductive areas 21, 22 can be defined with other shapes in other alternative embodiments, such as a curved shape or round in shape. The printed circuit board 2 also has a central hole 23 defined through a center thereof, a Light Emitting Diode (LED) 24 and a resistor (not numbered).

The cylindrical mating member 3 comprises a hollowed mating section 31 in a front end thereof, a polygonal flange 35 surrounding the cylindrical mating member 3, and a positive tube 32 located behind the polygonal flange 35 and communicated with an inner wall 36 of the cylindrical mating member 3. The mating section 31 serves as a negative portion of the mating member 3 and is isolated from the positive tube 32 by an insulator 34. The insulator 34 defines a through hole 341 in a center axis thereof along the pluggable direction, the through hole 341 is aligning with the central hole 23 of the printed circuit board 2 along the mating direction. A linking portion 311 is extending backwards from the mating section 31 on the side corresponding to the second conductive area 22 of the printed circuit board 2.

The light pipe 4 is of fork-shape and made of transparent plastic material to transmit the light from the LED 24. The light pipe 4 is also a hollowed configuration and defines two U-shaped cutouts 41 through the light pipe 4 along a direction perpendicular to the mating direction, and a pair of parallel protrusion 42 are formed on both sides of the cutouts 41. The protrusion 42 is adjacent to the LED 24 of the printed circuit board 2. The light pipe 4 also has a sleeve portion 43 connecting with the protrusions 42, a visible area 431 is formed on an end of the sleeve portion 43 to indicate the status of the LED 24 for users looking at. A block member (not shown) is inserted into the light pipe 4 through the cutouts 41 to prevent the insulative material from reaching the printed circuit board 2 when a strain relief is injection molded over the cable. The protrusions 42 are vertical to the printed circuit board 2 in the cable connector assembly 100, each protrusion 42 has a recess 421 in the surface neighboring to the printed circuit board 2, and the recesses 421 are aligning with the LED 24 respectively. Each protrusion 42 defines a slick arc surface on an exterior side and a slick plane on an interior side, so to make the light to the protrusions 42 homogeneous. Each protrusion 42 defines a gibbous block 422 on the exterior side thereof to be received in the rectangle groove 14 of the insulative shell 1.

The cable 6 comprises a fuscous strain relief portion 64 for releasing stress, a positive wire 61 and a negative wire 62 extending forwardly from the strain relief portion 64, and a middle wire 63 connected to a detective contact 631 and located between the positive wire 61 and negative wire 62. The positive wire 61 and negative wire 62 respectively have inner conductors 611, 621 and outer jackets 610, 620 with part of the corresponding outer jackets 610, 620 stripped away from front ends thereof.

Figure 4:
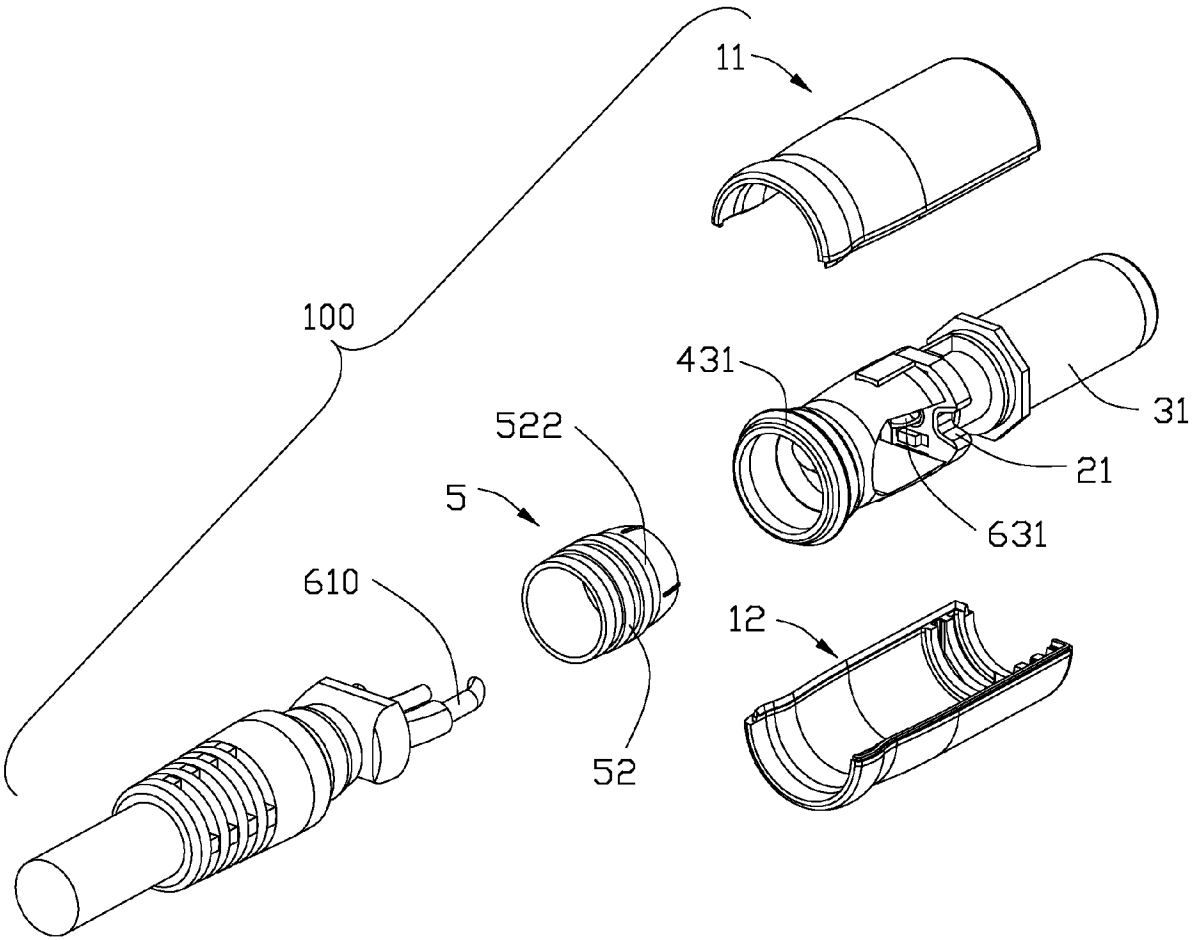
FIG. 4 is a partially assembled view of the cable connector assembly shown in FIG. 2.
Figure 5:
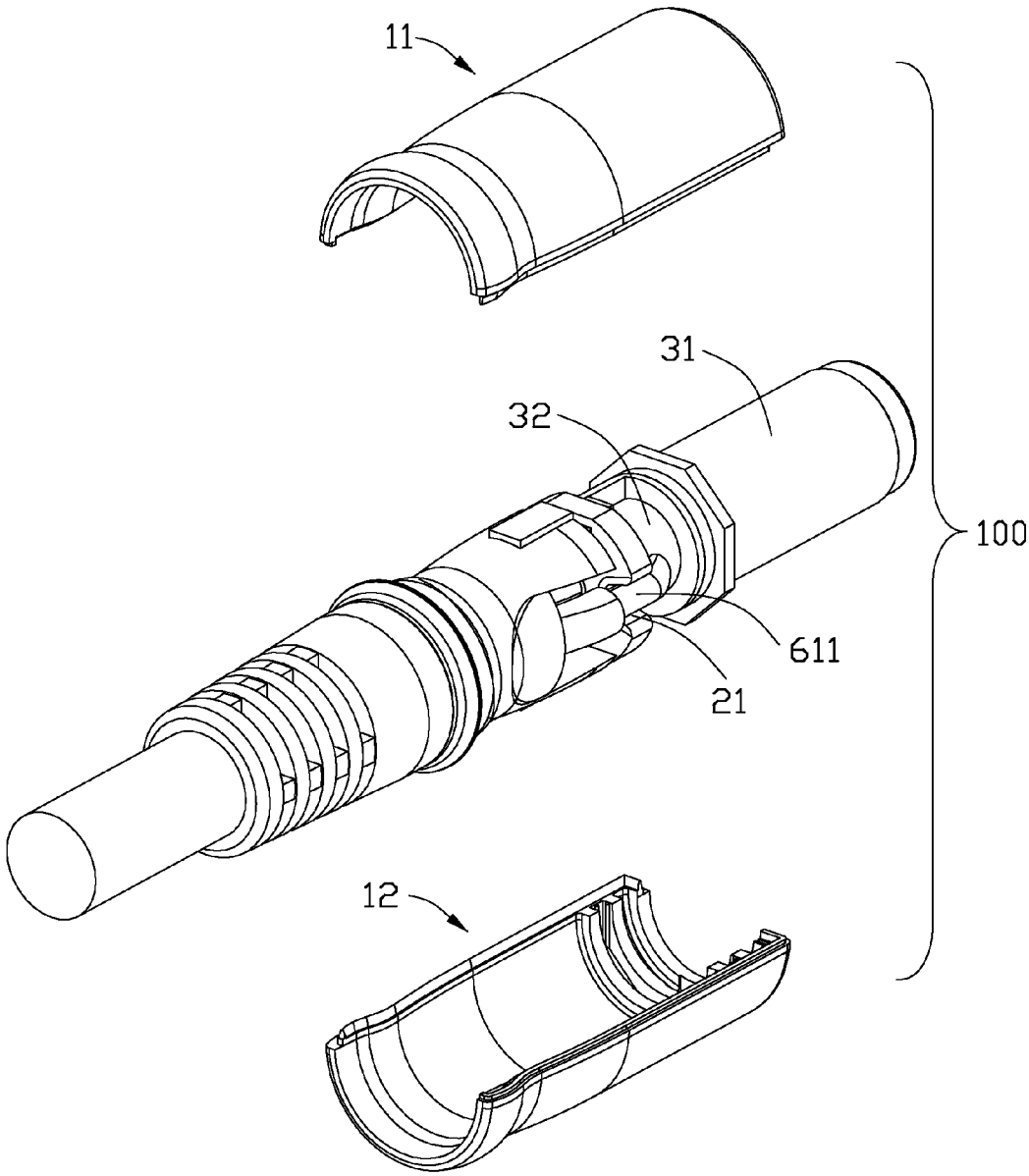
FIG. 5 is another partially assembled view of FIG. 2.
Figure 6:
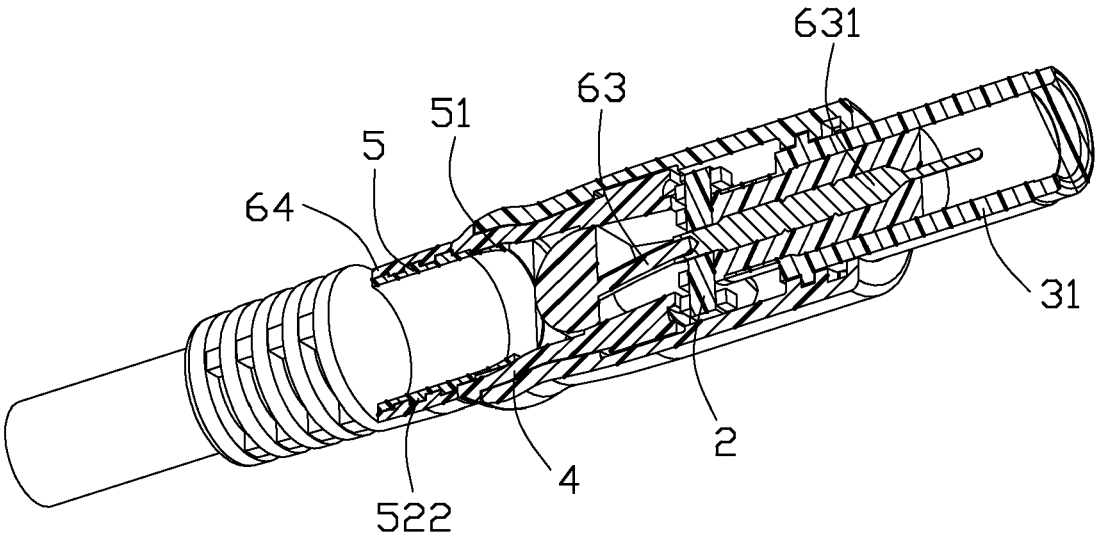
FIG. 6 is a cross-section view of the cable connector assembly shown in FIG. 1.

Referring to FIGS. 4-6, in assembling, the cylindrical mating member 3 is electrically connected with the cable 6, the detective contact 631 is accommodated in the through hole 341 of the mating member 3 and inserted into the central hole 23 of the printed circuit board 2, then the middle wire 63 is soldered to the detective contact 631. The inner conductor 611 of the positive wire 61 is soldered to the first conductive area 21 of the printed circuit board 2, and front end of inner conductor 611 is soldered to the positive tube 32 of the mating member 3. The linking portion 311 of the mating member 3 is soldered to the second conductive area 22 of the printed circuit board 2, and the inner conductor 621 of the negative wire 62 is soldered to the linking portion 311. The light pipe 4 is closed in insulative shell 1 with the gibbous blocks 422 received in the rectangle groove 14 of the insulative shell 1, and the LED 24 is aligning with the recess 421 and received in it.

The ring member 5 is made of transparent plastic material, and includes a slick loop portion 51 on a front end thereof and a retaining portion 52 behind the loop portion 51, said retaining portion 52 is defined with a rugged exterior surface. The retaining portion 52 has a larger length than the loop portion 51, and the retaining portion 52 defines a plurality of tubers 522 and a plurality of channels 521 alternately. Said loop portion 51 has an external diameter becoming more and more large along a front-to-back direction, so as to the ring member 5 can be inserted into the light pipe 4 easily. And said tubers 522 have bigger external diameters than the loop portion 51 on a rear end thereof. The loop portion 51 of the ring member 5 is located in the light pipe 4 and arranged neighboring to an internal wall of the light pipe 4, and the retaining portion 52 is located out of the light pipe 4. The ring member 5 is located on an interior side of the visible area 431 of the light pipe 4 with a front segment thereof and aligning with the visible area 431, the ring member 5 is enclosed in the strain relief portion 64 of the cable 6 (shown in FIG. 6) with a rear segment thereof. When the strain relief portion 64 is over-molded onto the ring member 5, as the retaining portion 52 of the ring member 5 has an enough length with tubers 522 and channels 521 in stagger relationship, such configuration can enhance the engagement between the ring member 5 and the strain relief portion 64, so the cable connector assembly 100 can work longer normally.

Then the top shell 12 is assembled to the bottom shell 11 to enclose the mating member 3 and other components mentioned formerly, the visible area 431 is exposed out of the insulative shell 1 to indicate the work status of the cable connector assembly 100. Thus, the cable connector assembly 100 is assembled. As the light pipe 4 is transparent, users may catch the vision of the cable of the cable connector assembly 100 from the light pipe 4 easily, and the cable connector assembly 100 may be unaesthetic, but the ring member 5 can help overcome the disadvantage to achieve aesthetic felling. The ring member 5 also can avoid the fuscous strain relief portion 64 preventing light passing through from the LED 24.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable connector assembly, comprising:

a mating member;

a printed circuit board;

a LED attached to the printed circuit board;

a light pipe having a visible area;

a cable having a positive wire and a negative wire connected with the mating member, and a strain relief portion molded on the wires, the strain relief portion neighboring to said light pipe;

a detective contact connecting with the cable;

an insulative shell enclosing the printed circuit board, the cable and the mating member, the visible area exposed out of the insulative shell; and a ring member having a slick loop portion located in said light pipe and a retaining portion with a rugged exterior surface, said strain relief portion molded on the retaining portion.

2. The cable connector assembly as claimed in claim 1, wherein said retaining portion defines a plurality of tubers and channels in stagger relationship.

3. The cable connector assembly as claimed in claim 2, wherein said retaining portion has a larger length than said loop portion.

4. The cable connector assembly as claimed in claim 3, wherein said loop portion has an external diameter becoming more and more large along a front-to-back direction, and at least one of said tubers has a bigger external diameter than a rear end of the loop portion.

5. The cable connector assembly as claimed in claim 4, wherein said light pipe has a sleeve portion neighboring to the ring member and a pair of protrusions spaced apart from each other to form a cutout.

6. The cable connector assembly as claimed in claim 5, wherein the sleeve portion is connected with the protrusions, the visible area is arranged on the end of the sleeve portion to indicate the status of the LED, and said loop portion is accommodated in the light pipe and neighboring to an interior side of the visible area.

7. The cable connector assembly as claimed in claim 6, wherein the protrusions are perpendicular to the printed circuit board, one of the protrusions has a recess neighboring to the printed circuit board, and the recess is aligned with the LED on the printed circuit board.

8. The cable connector assembly as claimed in claim 7, wherein the mating member has a through hole aligning with a central hole of the printed circuit board.

9. The cable connector assembly as claimed in claim 8, wherein the detective contact is received in the through hole of the mating member and has a part extending beyond the printed circuit board and inserted into the central hole.

10. The cable connector assembly as claimed in claim 8, wherein the printed circuit board defines a first conductive area and a second conductive area disposed on opposite edges thereof, the first conductive area is arranged in an aperture, and the second conductive area is disposed on an upright side of the printed circuit board.

11. The cable connector assembly as claimed in claim 7, further comprising an insulative shell, and wherein the protrusion defines a gibbous block on an exterior side thereof, and the insulative shell defines a groove receiving the gibbous block.

12. A cable connector assembly, comprising:

a mating member including a cylindrical housing defining a receiving cavity therein;

a detective pin extending into the receiving cavity, and a power collar disposed on a rear portion of the housing;

a cable having a strain relief portion and a wire connected with the detective pin;

a light pipe with a visible area; and a ring member having a front segment extending into the light pipe and a rear segment enclosed in the strain relief portion, and the front segment having a slick exterior surface with the rear segment having a plurality of tubers on an exterior surface thereof.

13. The cable connector assembly of claim 12, wherein said mating member has a linking portion on a rear end thereof, and the linking portion is connected with a printed circuit board.

14. The cable connector assembly of claim 13, wherein the cable also has another two wires electrically connected with the printed circuit board, and one of the wires is soldered to the printed circuit board and the mating member, another wire is soldered to the linking portion directly.

15. The cable connector assembly of claim 14, wherein the ring member is adjacent to the strain relief on interior side thereof.

16. A cable connector assembly, comprising:

a mating member;

a printed circuit board;

a LED attached to the printed circuit board;

a light pipe having a visible area;

a cable extending through the printed circuit board and connected with the mating member, and a strain relief portion molded on the wires, the strain relief portion neighboring to said light pipe;

a detective contact connecting with the cable;

an insulative shell enclosing said light pipe except the visible area; and a transparent ring member having a slick loop portion located in said light pipe, and a retaining portion molded within said strain relief portion molded.

* * * * *